United States Patent [19]

Mueller

[11] 4,027,600

[45] June 7, 1977

[54] COMBINATION SAFETY STOP AND DOWN LOCK FOR FOLDING TABLES

[75] Inventor: Floyd F. Mueller, Two Rivers, Wis.

[73] Assignee: American Hospital Supply Corporation, Evanston, Ill.

[22] Filed: June 17, 1976

[21] Appl. No.: 697,208

[52] U.S. Cl. ..... 108/113

[51] Int. Cl.[2] ..... A47B 3/00

[58] Field of Search ..... 108/112, 113; 16/191; 292/DIG. 65

[56] References Cited

UNITED STATES PATENTS

| | | | |
|---|---|---|---|
| 2,780,506 | 2/1957 | Howe | 108/113 |
| 3,101,064 | 8/1963 | Kanzeberger et al. | 108/113 |
| 3,861,325 | 1/1975 | Bue et al. | 108/113 X |

*Primary Examiner*—James C. Mitchell

[57] ABSTRACT

A folding table having a pair of table tops movable between folded and unfolded positions is provided with hinges and rods which cooperate to provide a releasable safety stop to prevent further movement of the table tops before the table tops reach their unfolded position and to releasably lock the table tops in their unfolded position. Each hinge includes a pair of facing hinge halves which are pivotally secured together and are provided with rod openings which are aligned when the table tops are in their unfolded position. A rod for each hinge is mounted on an elongated shaft which extends between and is slidably mounted on a hinge half of each of the hinges. When the table tops are in their folded position, each rod extends through the opening in one of the hinge halves and is engageable with an edge portion of the other hinge half of the hinge as the table tops approach their unfolded position to prevent further pivoting movement of the hinges and the table tops. Each rod can be withdrawn from engagement with the hinge half by movement of the shaft, and when the table tops reach their unfolded position, the rods can be inserted through the aligned openings of each hinge to lock the table tops.

9 Claims, 9 Drawing Figures

COMBINATION SAFETY STOP AND DOWN LOCK FOR FOLDING TABLES

BACKGROUND

This invention relates to folding tables of the type which are commonly used in schools, cafeterias, meeting rooms, and the like. Such tables usually include a pair of flat table tops which are mounted on a frame for movement between an unfolded position in which the table tops extend generally horizontally and a folded position in which the table tops extend generally vertically with the top surfaces of the table tops facing away from each other.

The usual manner of unfolding such a table is to grasp each table top and spread the table top toward the horizontal position while restraining the center of the table, i.e., the facing edges of the table tops, from moving downwardly too quickly. However, a person who is unfamiliar with the table or a person with insufficient strength to hold the center, such as a child, might unfold the table top to a position at which gravity would cause the raised center of the table to drop into a horizontal position. If the facing edges of the table top abut each other or are closely spaced when the table tops are unfolded, a crush point exists between the table tops which could injure the user.

The table tops of benchless folding tables that are presently on the market generally abut at the center when the table tops are in the unfolded position. Although the hazard presented by the abutting table tops could be removed by spacing the table tops, as is the case in folding tables having seats, such a space is undesirable because it decreases usable table surface and because pencils and other articles could drop through the space.

SUMMARY OF THE INVENTION

The invention prevents the table top from being moved directly from a folded to an unfolded position. A safety stop rod extends through an opening in one of the facing hinge halves of one or more of the table hinges and is engageable with the other hinge half as the hinges and table tops pivot toward their unfolded position. The rods prevent further pivoting movement of the hinges and table tops and enable the user to make sure his fingers are removed from the space between the table tops before the table tops reach the unfolded position. A spring maintains the rods in the safety stop position, and the table tops can be completely unfolded only if the rods are moved out of engagement with the hinge halves by compressing the spring. Each rod is mounted on an elongated shaft, and the rods are moved simultaneously by moving the shaft. When the table tops are completely unfolded, the compressed spring snaps the rods through aligned openings in the hinge halves, thereby locking the table tops in the unfolded position. The table can be folded by moving the shaft to withdraw each rod from one of the aligned openings, and as the table folds the spring will move the rods back to their safety stop positions.

DESCRIPTION OF THE DRAWING

The invention will be explained in conjunction with an illustrative embodiment shown in the accompanying drawing, in which.

DESCRIPTION OF SPECIFIC EMBODIMENT

Figure 1:
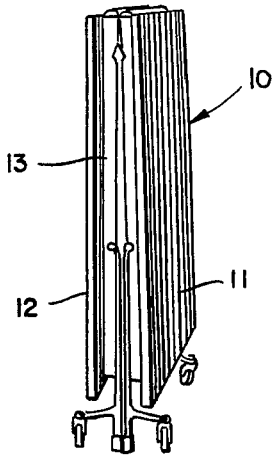
FIG. 1 is a perspective view of a folding table equipped with a combination safety stop and down lock mechanism in accordance with the invention.
Figure 2:
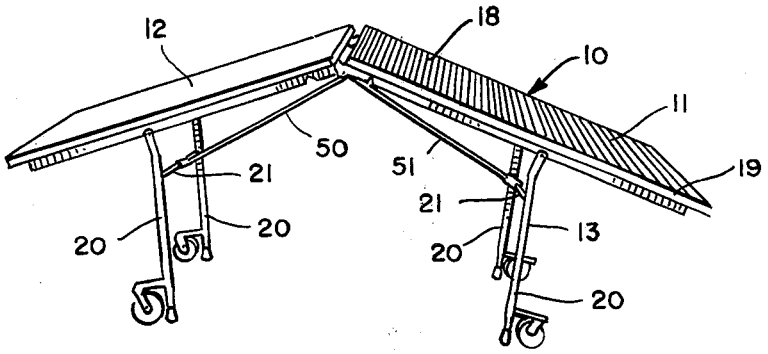
FIG. 2 is a perspective view of the table unfolded to the safety stop position.
Figure 3:
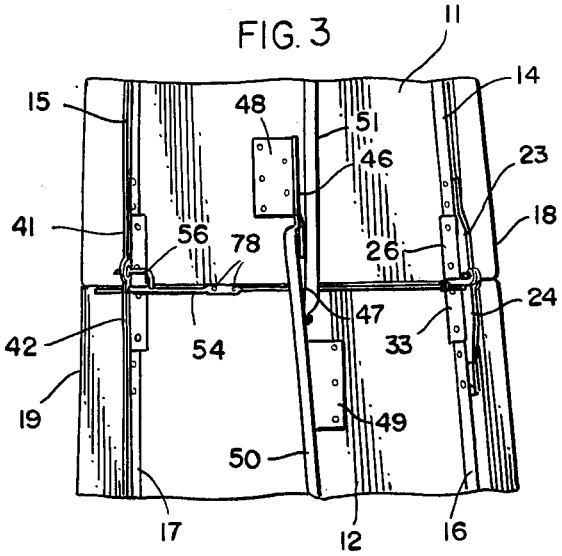
FIG. 3 is a fragmentary bottom plan view of the table in its unfolded or down position.

Referring first to FIGS. 1–3, the numeral 10 designates generally a folding table having a pair of flat table tops 11 and 12 which are mounted on a metal supporting frame 13. With the exception of the locking hinges and locking shaft assembly which will be described hereinafter, the table is conventional and need not be described in detail.

The frame includes a pair of reinforcing angles 14 and 15 secured to the bottom surface of the table top 11 and a pair of reinforcing angles 16 and 17 secured to the bottom of the table top 12. The angles are positioned near the right and left edges 18 and 19 of the table, but the table tops overhang sufficiently to conceal the angles and the locking mechanism. A wheel-equipped support leg 20 is pivotally connected to each of the angles, and the support legs for each table are connected by a cross brace 21.

A hinge member 23 is secured to the bottom of the table top 11, and a hinge member 24 is secured to the bottom of the table top 12. These two hinge members or hinge halves are pivotally connected to form a hinge for the table tops. The hinge member 23 includes a generally flat vertically extending portion 25 (FIG. 5) and a base flange 26 which is secured to the table top by screws 27. The rear end of the vertically extending portion, i.e., the end extending away from the facing edges 28 and 29 (FIG. 4) of the table tops, is secured to the angle 14 by spotwelds 30. The front end of the hinge member 23 includes a hinge portion 31 which is offset at 3 (see also FIGS. 8 and 9) from the remainder of the vertically extending portion of the hinge.

The hinge member 24 is similarly formed and includes a base portion 33 which is secured to the table top 12 by screws 34 and a vertically extending portion 35 which is secured to the angle 16 by spotwelds 36. The hinge member 24 includes a front hinge portion 37 which is offset at 38 (FIGS. 8 and 9) from the remainder of the vertically extending portion of the hinge.

The lower ends of the hinge portions 31 and 37 of the two hinge halves are pivotally connected by a pin 39 (FIGS. 4 and 5), and the right side of the table tops are thereby hingedly connected.

The left side of the table includes similar hinge members 41 and 42 (FIGS. 3 and 6–9) which are secured, respectively, to the table tops 11 and 12. The hinge member 41 is substantially identical to the hinge member 24 and is secured to the bottom of the table top 11 and to the reinforcing angle 15. The hinge member 42 is substantially identical to the hinge member 23 and is secured to the bottom of the table top 12 and to the reinforcing angle 17. The lower ends of the offset front portions 43 and 44 of the hinge members are pivotally connected by a pin 45 for hingedly connecting the left side of the table tops.

In the particular embodiment illustrated the midpoints of the table tops are also hingedly connected by hinge halves 46 and 47 (FIG. 6) which are substantially identical to the hinge halves 41 and 42 and which are secured to the table tops 11 and 12, respectively. Referring to FIG. 3, the rear ends of the center hinge members are also secured to the vertical flange of reinforcing braces 48 and 49 which are secured to the table tops 11 and 12. Center bracing rods 50 and 51 are pivotally connected to the hinge members 46 and 47, respectively, and to the leg cross braces 21 (FIG. 2).

The three hinges hingedly connect the table tops 11 and 12 for movement from the folded position illustrated in FIG. 1 to an unfolded or down position in which the table tops extend horizontally. The pivot pins of the hinges are spaced below the facing edges 28 and 29 of the table tops when the table tops are unfolded (see pins 39 and 45 in FIGS. 5 and 7) to provide an off-center hinge which pivots the facing edges of the table tops away from each other when the table tops pivot to their folded position to accommodate the supporting frame of the table between the table tops as shown in FIG. 1.

When the table tops are pivoted to the unfolded position, the facing edges 28 and 29 thereof abut each other, and the facing edges of the base flanges 26 and 33 of the hinge members 23 and 24 (see FIGS. 5 and 8) also contact each other to prevent the abutting facing edges of the table tops from compressing together too tightly. Similarly, the facing edges of the base flanges of the hinge members 41 and 42 and 46 and 47 contact each other in the unfolded position.

An elongated rod-like shaft 54 extends through an opening in each of the hinge members 24, 47, and 42 which are secured to the table top 12. The opening in each of the hinge members is positioned rearwardly of the offset forward hinge portion of the hinge member (see FIG. 8), i.e., the opening is spaced from the offset portion in a direction extending away from the facing edges 28 and 29 of the table tops. Each of the openings is sized to permit the shaft to slide freely through the opening in an axial direction without excessive transverse movement. Right and left locking rods 55 and 56 are mounted on the shaft 54, and both rods extend in the same direction parallel to the axis of the shaft 54. In the particular embodiment illustrated the locking rod 55 is provided by a continuation of the shaft 54 and is connected to the main portion of the shaft by a U-shaped curved portion 57. The locking rod 56 is generally L-shaped and includes an attaching portion 58 which extends perpendicularly to the shaft 54 and is welded thereto.

The locking rod 55 extends from the right side of the hinge members 23 and 24 toward the hinge members, and the locking rod 56 extends from the right side of the hinge members 41 and 42 toward the hinge members. Each of the hinge members 23 and 24 is provided with an opening 60 and 61 (FIGS. 8 and 9) which are aligned when the table tops are in the unfolded position and through which the locking rod 55 can extend to lock the hinge members 23 and 24 in the unfolded position. Similarly, the hinge members 41 and 42 are provided with openings 62 and 63 which are aligned when the table tops are in the unfolded positions and through which the locking rod 56 can extend to lock the hinge members. The rod openings in the hinge members are provided in the front hinge portions thereof above the opening for the hinge pin.

A square reinforcing plate 65 (FIGS. 8 and 9) is secured to the hinge portion 31 of the hinge member 23 to reinforce the edge of the hinge portion and to assist in maintaining the end of the locking rod 55 in alignment with the opening 60 in the hinge member, and a square reinforcing plate 66 is secured to the hinge member 24. Similarly, reinforcing plates 67 and 68 are secured to the hinge members 41 and 42.

The locking rods are maintained in the down-lock position when the table is unfolded by a coil spring 69 which is compressed between the hinge member 24 and a stop washer 70 on the rod-supporting shaft 54 which engages a pin 71 which extends through the shaft. The shaft 54 and the locking rods 55 and 56 are prevented from being moved to the left beyond the position illustrated in FIG. 8 by a stop washer 72 which engages the hinge member 42 on the left side of the table and which is fixed against movement to the right in FIG. 8 by a pin 73 which extends through the shaft.

Figures 8, 9:
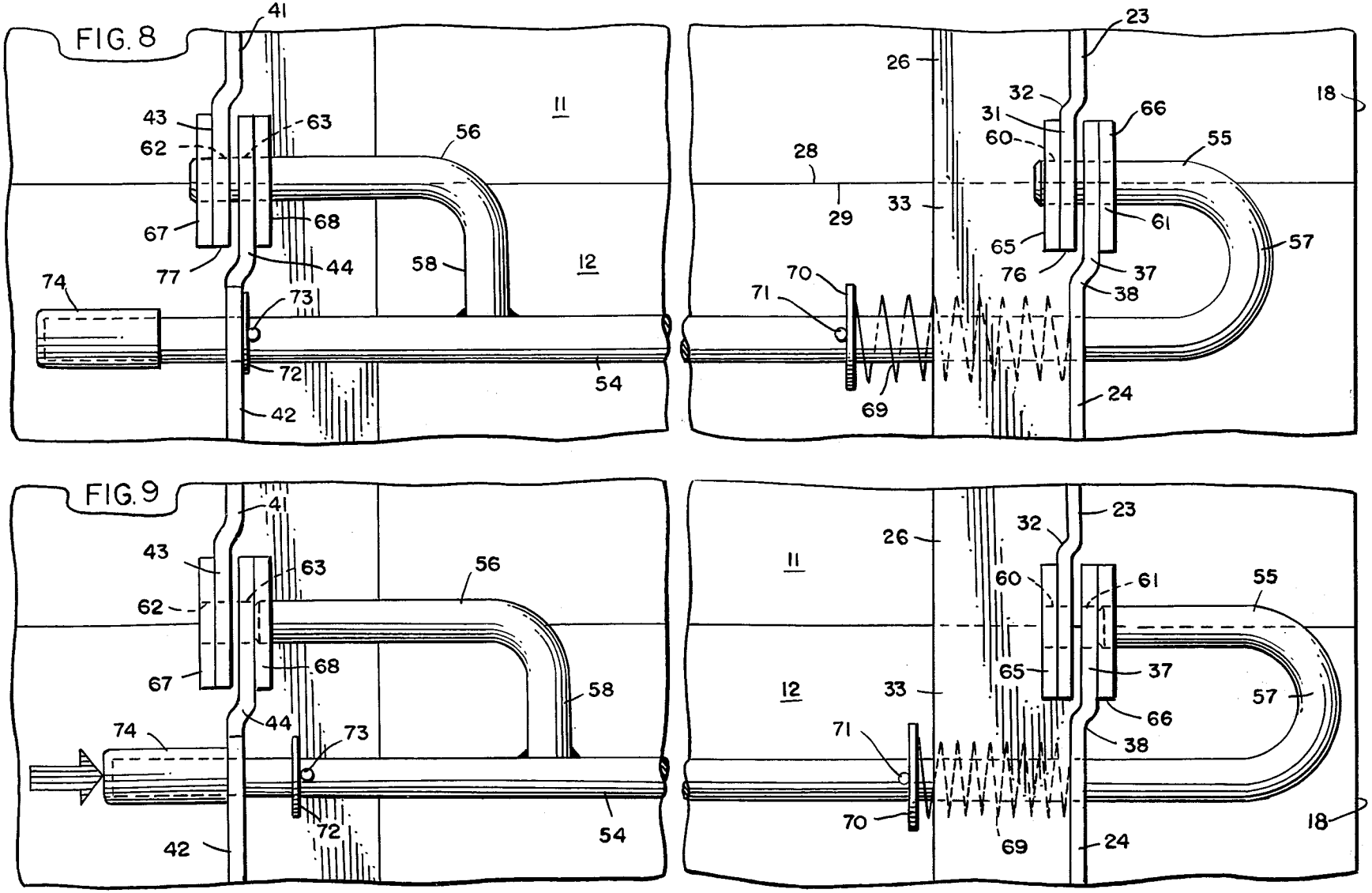
FIG. 8 is an enlarged fragmentary bottom plan view of the locking hinges on both sides of the table when the table is locked in its unfolded position.
FIG. 9 is a view similar to FIG. 8 showing the locking rods withdrawn to an unlocking position.

When the shaft and locking rods are in the down-lock position illustrated in FIG. 8, the hinge members are prevented from pivoting relative to each other, and the table tops are locked in their unfolded position. When it is desired to fold the table, the shaft is moved to the right as viewed in FIGS. 8 and 9, i.e., toward the right edge 18 of the table, against the bias of the coil spring 69. When the shaft 54 is moved to the right sufficiently to withdraw the ends of the locking rods 55 and 56 from the openings 60 and 62 in the hinge members 23 and 41 as shown in FIG. 9, the hinge members are free to pivot relative to each other, and the table can be folded upwardly. The curved connecting portion 57 between the locking rod 55 and the shaft 54 provides a convenient finger grip for pulling the rod to the right as viewed in FIGS. 8 and 9, and the rod can also be pushed to the right by pushing the left end of the rod.

The minimum compressed length of the spring 69 is advantageously such that the ends of the locking rods cannot be moved to the right beyond the position illustrated in FIG. 9 so that the ends remain positioned within the openings in the hinge members 24 and 42 or the reinforcing plates 66 and 68. If the spring 69 can be compressed sufficiently to withdraw the ends of the locking rods completely from the reinforcing plates, additional stop washers 70 can be added to prevent this excessive movement. The end of the shaft 54 which extends through the hinge member 42 may be covered by a protective end cap 74, which also assists in limiting the withdrawal of the locking rods from the hinge members 24 and 42. However, the minimum compression length of the coil spring provides a more reliable stop.

After the table tops have been pivoted away from their unfolded position, the shaft 54 can be released, and the spring 69 will return the locking rods 55 and 56 to their original position illustrated in FIG. 8. However, the upper ends of the hinge portions 31 and 43 of the hinge members 23 and 41 through which the openings 60 and 62 extend will have been pivoted away from the openings 61 and 63 in the hinge members 24 and 42, and the locking rods will extend through only the hinge members 24 and 42.

Figure 4:
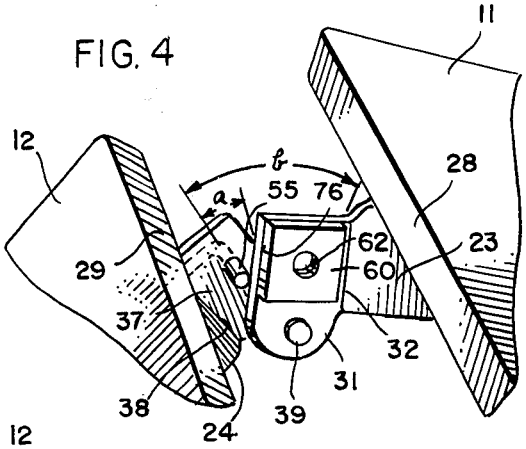
FIG. 4 is a fragmentary perspective view showing the position of the locking hinge on one side of the table just before the table reaches the safety stop position.
Figure 5:
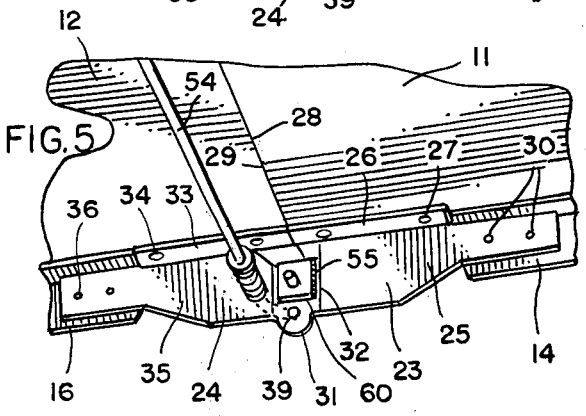
FIG. 5 is a fragmentary perspective view showing the hinge of FIG. 4 when the table is locked in its unfolded position.
Figure 6:
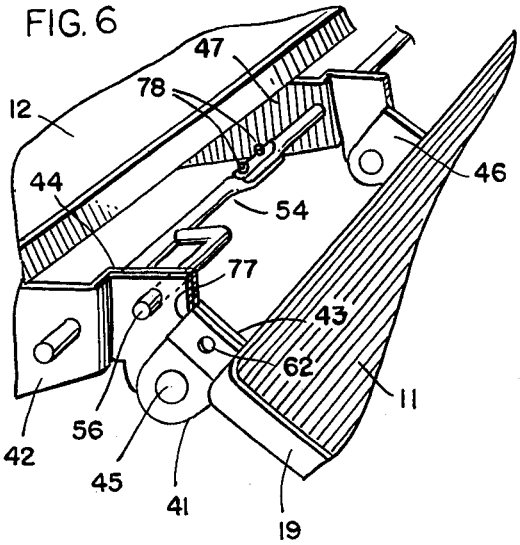
FIG. 6 is a fragmentary perspective view of the locking hinge on the other side of the table just before the table reaches the safety stop position.
Figure 7:
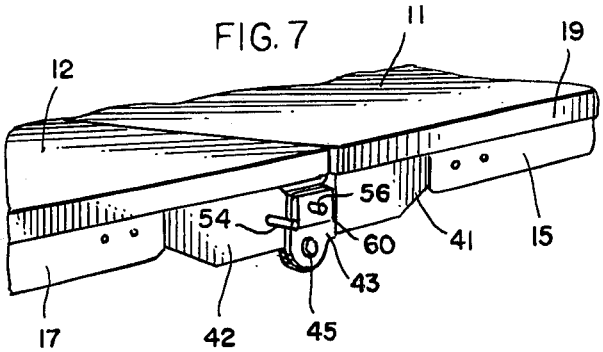
FIG. 7 is a fragmentary perspective view showing the hinge of FIG. 6 when the table is locked in its unfolded position.

When the table tops are moved from the folded position toward the unfolded position, the locking rods 55 and 56 extend through the openings in the hinge members 24 and 42. As the upper portions of the hinge portions 31 and 43 of the hinge members 23 and 41 pivot toward the folded position in which the openings therein are aligned with the openings in the hinge members 24 and 42, and the front edge portion of the hinge members 23 and 41 will engage the locking rods and be prevented from further pivoting movement. FIGS. 4 and 6 illustrate the table tops and the hinges just prior to the position in which the hinge members 23 and 41 engage the locking rods. Referring first to FIG. 4, the hinge member 23 can pivot about the pivot pin 39 relative to the hinge member 24 through the small angle *a* before the front edge of the hinge member 23 will engage the locking rod 55. The table tops will not reach the unfolded position until the hinge member 23 pivots on the hinge pin 39 relative to the hinge member 24 through the larger angle *b*. In the embodiment illustrated the front edge 76 of the hinge member 23 which is engageable with the locking rod is provided with double metal thickness as a bearing area for the locking rod by virtue of the reinforcing plate 65. Similarly, referring to FIG. 6, the front edge 77 of the hinge member 41 which is engageable with the locking rod 56 is provided with a double thickness bearing area by the reinforcing plate 67. If desired, the reinforcing plates could be eliminated and the front edges of the hinge members could be hardened or otherwise reinforced.

When the bearing areas engage the locking rods 55 and 56, the hinge members and the table tops are prevented from pivoting any farther, and the table tops are maintained in a safety stop position illustrated in FIG. 2. In this position the facing edges 28 and 29 (FIG. 4) of the table tops are spaced apart, and the user of the table can assure himself that his fingers and other objects are removed from the space between the table tops. The table tops cannot move from the safety stop position to the unfolded position until the locking rods 55 and 56 are withdrawn from engagement with the bearing areas. This can be done by raising one of the facing edges of the table tops with one hand to pivot the hinge members slightly to relieve the pressure on the locking rods while pulling the curved grip portion 57 of the shaft with the other hand. Alternatively, the end cap 74 could be pushed. Since the user must stand at one side of the table to release the table from the safety stop position, there is little likelihood that his fingers will be positioned in the space between the table tops. When the locking rods are withdrawn sufficiently to permit the hinge members to continue to pivot relative to each other, the table tops can be lowered into the unfolded position. The withdrawing force exerted on the shaft 54 can be released as soon as the front edges of the hinge members 23 and 41 pass over the rod openings in the other hinge members, and when the hinge members reach the unfolded position in which the openings therein are aligned, the spring 69 will snap the locking rods through the hinge members 23 and 41 to lock the table in the down or unfolded position.

In the particular embodiment illustrated, locking rods were provided for the hinges on both the right and left sides of the table, and both locking rods are movable simultaneously by the supporting shaft 54. However, depending upon the size of the table, it may be possible to use a locking rod for only one of the hinges. Although a locking rod was not used for the hinge members 46 and 47, locking means could also be provided for these hinge members if desired.

The particular supporting shaft 54 illustrated in the drawings is formed in two parts which are connected by screws 78 (FIGS. 3 and 6). This enables the shaft and locking rods to be positioned with respect to the hinge members after the hinge members are secured to the table tops. However, if desired, the shaft can be formed integrally and inserted through the openings in the hinge members before the hinge members are secured to the table tops.

While in the foregoing specification a detailed description of a specific embodiment of the invention was set forth for the purpose of illustration, it is to be understood that many of the details herein given may be varied considerably by those skilled in the art without departing from the spirit and scope of the invention.

I claim:

1. In a folding table having a frame and a pair of table tops mounted on the frame, the table tops being movable between an unfolded position in which the table tops extend generally horizontally and a folded position in which the table tops extend generally vertically, a first hinge member secured to one of the table tops, and a second hinge member secured to the other table top, the first and second hinge members being pivotally connected for pivoting movement as the table tops move between their folded and unfolded positions, the first hinge member being provided with an opening therethrough and the second hinge member being provided with an opening which is aligned with the opening in the first hinge member when the table tops are in their unfolded position, a rod reciprocably mounted on the second hinge member and extending through the aligned openings of the first and second hinge members when the table tops are in their unfolded position whereby the hinge members are prevented from pivoting and the table tops are prevented from moving from their unfolded position, the rod extending through the opening of the second hinge member when the table tops are in their folded position and being engageable by the first hinge member as the table tops move toward their unfolded position and as the opening in the first hinge member and the opening in the second hinge member pivot toward each other to prevent further pivoting movement of the hinge member and to prevent the table tops from reaching their unfolded positions, the rod being withdrawable from engagement with the first hinge member so that the table tops can move to their unfolded positions, the rod being insertable into the aligned openings of the first and second hinge members when the table tops reach their unfolded positions.

2. The structure of claim 1 in which the rod is attached to a mounting shaft which is axially slidably mounted in a second opening in the second hinge member, the rods and the shaft extending parallel to each other so that axial sliding movement of the shaft moves the rod into and out of engagement with the first hinge member.

3. The structure of claim 2 in which the rod and the shaft are formed integrally from a single rod, the rod being attached to the shaft by a U-shaped connecting portion.

4. The structure of claim 2 including spring means mounted on the shaft for resiliently biasing the shaft against movement in a direction which would withdraw the rod from engagement with the first hinge member.

5. The structure of claim 2 including a third hinge member secured to said one of the table tops and a fourth hinge member secured to the other table top, the third and fourth hinge members being pivotally connected for pivoting movement as the table tops move between their folded and unfolded positions, the third hinge member being provided with an opening therethrough and the fourth hinge member being provided with an opening which is aligned with the opening in the third hinge member when the table tops are in their unfolded position, the mounting shaft extending between the second and fourth hinge members and being axialy slidably mounted in a second opening in the fourth hinge member, a second rod attached to the mounting shaft and extending through the aligned openings of the third and fourth hinge members when the table tops are in their unfolded position whereby the third and fourth hinge members are prevented from pivoting and the table tops are prevented from moving from their unfolded position, the second rod extending through the rod opening of the fourth hinge member when the table tops are in their folded position and being engageable by the third hinge member as the table tops move toward their unfolded position and as the rod opening in the third hinge member and the rod opening in the fourth hinge member pivot toward each other to prevent further pivoting movement of the third and fourth hinge members.

6. The structure of claim 5 in which each of the hinge members have right and left side surfaces, the right side surfaces of the first and third hinge members facing the left side surfaces of the second and fourth hinge members, both rods extending from the shaft through the rod opening of their respective hinge members in a right-to-left direction so that movement of the shaft in a left-to-right direction moves the rods out of engagement with the first and third hinge members.

7. In a folding table having a frame and first and second table tops mounted on the frame, each of the table tops having top and bottom surfaces and right and left sides and the table tops being movable between an unfolded position in which the table tops extend generally horizontally and a folded position in which the table tops extend generally vertically, a first hinge secured to the bottom surfaces of the table tops adjacent the right sides thereof and a second hinge secured to the bottom surfaces of the table tops adjacent the left sides thereof, the first hinge including right and left hinge members pivotally secured together and secured, respectively, to the first and second table tops, the second hinge member including right and left hinge members pivotally secured together and secured, respectively, to the first and second table tops, an elongated shaft extending between the right hinge members of the first and second hinge and being axially slidably mounted in shaft openings in the right hinge members, the right and left hinge members of each of the first and second hinges being provided with rod openings which are aligned when the table tops are in their unfolded positions, a first rod mounted on the shaft and extending in a right-to-left direction through the aligned openings of the hinge members of the first hinge when the table tops are in their unfolded position, a second rod mounted on the shaft and extending in a right-to-left direction through the aligned openings of the hinge members of the second hinge when the table tops are in their unfolded position, whereby the hinge members are prevented from pivoting and the table tops are prevented from moving from their unfolded position, the first and second rods extending through the rod openings in the right hinge members when the table tops are in their folded position and being engageable with the left hinge members as the table tops move toward their unfolded position to prevent the table tops from reaching their unfolded position, the first and second rods being withdrawable from engagement with the left hinge members by movement of the shaft in a left-to-right direction so that the table tops can move to their unfolded positions, the first and second rods being insertable into the rod openings of the left hinge members when the table tops reach their unfolded position.

8. The structure of claim 7 in which one of the rods is formed integrally with the shaft and is connected thereto by a U-shaped connecting portion.

9. The structure of claim 7 including spring means mounted on the shaft for resiliently biasing the shaft against movement in a left-to-right direction.

* * * * *